US008499967B2

(12) United States Patent
Michelli

(10) Patent No.: US 8,499,967 B2
(45) Date of Patent: Aug. 6, 2013

(54) METHODS AND APPARATUS FOR DISPENSING SOLID ARTICLES

(75) Inventor: Richard D. Michelli, Raleigh, NC (US)

(73) Assignee: Parata Systems, LLC, Durham, NC (US)

( * ) Notice: Subject to any disclaimer, the term of this patent is extended or adjusted under 35 U.S.C. 154(b) by 917 days.

(21) Appl. No.: 12/492,933

(22) Filed: Jun. 26, 2009

(65) Prior Publication Data

US 2010/0006584 A1 Jan. 14, 2010

Related U.S. Application Data

(60) Provisional application No. 61/080,365, filed on Jul. 14, 2008, provisional application No. 61/143,286, filed on Jan. 8, 2009.

(51) Int. Cl.
*B65H 3/08* (2006.01)
*G07F 11/00* (2006.01)

(52) U.S. Cl.
USPC ..... 221/278; 221/267; 221/156; 221/163; 221/211; 221/13; 221/64; 221/65; 221/126; 221/127; 221/174; 221/1; 221/9; 211/1; 211/7; 211/10; 324/555; 324/556; 250/215; 250/222.1; 250/223 R; 250/224; 700/231

(58) Field of Classification Search
USPC ..... 250/215, 222.1, 223 R, 224; 221/174, 221/267, 156, 163, 211, 278, 13, 64, 65, 221/126, 127, 1, 9; 324/555, 556; 211/1, 211/7, 10; 700/231
See application file for complete search history.

(56) References Cited

U.S. PATENT DOCUMENTS

| | | | | |
|---|---|---|---|---|
| 4,018,358 | A | 4/1977 | Johnson et al. | |
| 4,573,606 | A | 3/1986 | Lewis et al. | |
| 4,674,651 | A | 6/1987 | Scidmore et al. | |
| 4,697,721 | A | 10/1987 | Johnson et al. | |
| 4,801,044 | A * | 1/1989 | Kubota et al. | 221/163 |
| 5,325,801 | A | 7/1994 | Fiorido | |
| 5,385,434 | A * | 1/1995 | Quinn et al. | 406/73 |
| 5,405,048 | A | 4/1995 | Rogers et al. | |
| 5,571,258 | A * | 11/1996 | Pearson | 221/211 |
| 6,053,302 | A | 4/2000 | Leu et al. | |
| 6,561,377 | B1 | 5/2003 | Pearson et al. | |
| 6,631,826 | B2 * | 10/2003 | Pollard et al. | 221/156 |

(Continued)

OTHER PUBLICATIONS

U.S. Appl. No. 12/349,287, filed Jan. 6, 2009, titled "Methods and Apparatus for Dispensing Solid Articles," 59 pages.

(Continued)

*Primary Examiner* — Gene O. Crawford
*Assistant Examiner* — Rakesh Kumar
(74) *Attorney, Agent, or Firm* — Myers Bigel Sibley & Sajovec, PA

(57) ABSTRACT

An apparatus for dispensing solid articles includes a housing and at least one vacuum source. The housing defines a hopper chamber to hold the articles and a dispensing channel fluidly connected to the hopper chamber. The dispensing channel has an inlet and an outlet defining a dispensing flow path therebetween. The vacuum source is adapted to provide a vacuum pressure and induce a gas flow in the housing. The apparatus is configured to generate a forward drive gas flow from the vacuum pressure and induced gas flow, and the forward drive gas flow conveys articles through the dispensing channel along the dispensing flow path in a direction from the inlet to the outlet to dispense the articles.

24 Claims, 12 Drawing Sheets

U.S. PATENT DOCUMENTS

| | | | | |
|---|---|---|---|---|
| 6,634,826 | B1 * | 10/2003 | Marsetti | 403/325 |
| 6,971,541 | B2 * | 12/2005 | Williams et al. | 221/13 |
| 6,971,544 | B2 * | 12/2005 | Williams et al. | 221/167 |
| 6,997,341 | B2 | 2/2006 | Pearson et al. | |
| 7,303,094 | B2 | 12/2007 | Hutchinson et al. | |
| 7,344,049 | B2 * | 3/2008 | Daniels et al. | 221/92 |
| 7,726,514 | B2 * | 6/2010 | Janet et al. | 221/221 |
| 7,837,061 | B2 * | 11/2010 | Dummer et al. | 221/278 |
| 7,919,427 | B2 * | 4/2011 | Ota et al. | 502/185 |
| 8,054,086 | B2 * | 11/2011 | Rivenbark, Jr. | 324/555 |
| 8,091,733 | B2 * | 1/2012 | Janet et al. | 221/211 |
| 2006/0006190 | A1 | 1/2006 | Janet et al. | |
| 2007/0264926 | A1 | 11/2007 | Sonntag | |
| 2008/0029535 | A1 * | 2/2008 | Kim | 221/167 |
| 2008/0061074 | A1 | 3/2008 | Remis et al. | |
| 2008/0110555 | A1 | 5/2008 | Bouchelle et al. | |
| 2008/0110921 | A1 | 5/2008 | DuMond et al. | |
| 2008/0168751 | A1 | 7/2008 | Sink et al. | |
| 2008/0283549 | A1 | 11/2008 | Dummer et al. | |
| 2008/0283734 | A1 | 11/2008 | Michelli et al. | |
| 2008/0288105 | A1 | 11/2008 | Mauger et al. | |
| 2009/0039097 | A1 | 2/2009 | Farnsworth et al. | |
| 2009/0140002 | A1 | 6/2009 | Farnsworth et al. | |

OTHER PUBLICATIONS

Office Action received in corresponding Canadian Application No. 2,671,098 mailed May 10, 2011 (3 pages).

Office Action received in corresponding Canadian Application No. 2,671,098 mailed Jan. 31, 2012 (3 pages).

* cited by examiner

METHODS AND APPARATUS FOR DISPENSING SOLID ARTICLES

RELATED APPLICATION(S)

This application claims the benefit of and priority from U.S. Provisional Patent Application No. 61/080,365, filed Jul. 14, 2008, and U.S. Provisional Patent Application No. 61/143,286, filed Jan. 8, 2009, the disclosures of which are incorporated herein by reference in their entireties.

FIELD OF THE INVENTION

The present invention is directed generally to the dispensing of solid articles and, more specifically, is directed to the automated dispensing of solid articles, such as solid pharmaceutical articles.

BACKGROUND OF THE INVENTION

Pharmacy generally began with the compounding of medicines which entailed the actual mixing and preparing of medications. Heretofore, pharmacy has been, to a great extent, a profession of dispensing, that is, the pouring, counting, and labeling of a prescription, and subsequently transferring the dispensed medication to the patient. Because of the repetitiveness of many of the pharmacist's tasks, automation of these tasks has been desirable.

Some attempts have been made to automate the pharmacy environment. For example, U.S. Pat. No. 6,971,541 to Williams et al. describes an automated system for dispensing pharmaceuticals using dispensing bins. Each dispensing bin includes a hopper in which tablets are stored and a dispensing channel fluidly connecting the hopper to a dispensing outlet. Forward and reverse air flows are used to selectively convey the tablets through the dispensing channel in each of a dispensing direction (toward the outlet) and a reverse direction (toward the hopper). A counting sensor is positioned proximate the outlet of the dispensing channel and used to detect tablets passing the sensor in order to maintain a count of the tablets dispensed.

SUMMARY OF THE INVENTION

According to embodiments of the present invention, an apparatus for dispensing solid articles includes a housing and at least one vacuum source. The housing defines a hopper chamber to hold the articles and a dispensing channel fluidly connected to the hopper chamber. The dispensing channel has an inlet and an outlet defining a dispensing flow path therebetween. The vacuum source is adapted to provide a vacuum pressure and induce a gas flow in the housing. The apparatus is configured to generate a forward drive gas flow from the vacuum pressure and induced gas flow, and the forward drive gas flow conveys articles through the dispensing channel along the dispensing flow path in a direction from the inlet to the outlet to dispense the articles.

According to some embodiments, the apparatus includes an expansion region downstream of the outlet along the dispensing flow path. The apparatus is configured such that the forward drive gas flow conveys the articles through the dispensing channel and into the expansion region where the velocity of the forward drive gas flow is reduced and the articles decouple from the forward drive gas flow to be dispensed.

In some embodiments, the apparatus is further configured to generate a reverse drive gas flow from the vacuum pressure and induced gas flow. The reverse drive gas flow conveys articles through the dispensing channel along the dispensing flow path in a direction from the outlet to the inlet to return the articles to the hopper chamber.

The apparatus may include a control port in the housing and a closure mechanism operable to selectively open and close the control port, wherein: when the control port is closed, the forward drive gas flow is generated from the vacuum pressure and induced gas flow; and when the control port is open, the reverse drive gas flow is generated from the vacuum pressure and induced gas flow. In some embodiments, when the control port is open, the vacuum pressure draws ambient air into the housing to generate the forward drive gas flow. In some embodiments, the closure mechanism includes an actuator operable to selectively open and close the control port.

According to some embodiments, the housing includes a dispensing portal and the apparatus includes a gate system. The gate system includes a gate member positioned in the dispensing pathway. The gate member is selectively positionable between an open position and a closed position. When the gate member is in the open position, the gate member permits the articles to pass through the portal. When the gate member is in the closed position, the gate member blocks the articles from passing through the portal. The gate member may include perforations therein for the passage of the reverse drive gas flow. In some embodiments, the perforations are blocked when the gate member is in the open position and the housing includes a return opening downstream along the dispensing flow path for the passage of the forward drive gas flow from the outlet to the vacuum source. A holding mechanism may be provided to hold the gate member in the closed position when the reverse drive gas flow is being generated.

According to some embodiments, the apparatus is configured to generate an agitation gas flow from the vacuum pressure and induced gas flow, wherein the agitation gas flow agitates articles in the hopper chamber. In some embodiments, the apparatus is configured to generate the agitation gas flow and the forward drive gas flow simultaneously using the vacuum pressure and induced gas flow from the vacuum source. The apparatus may be configured to generate the agitation gas flow and the forward drive gas flow simultaneously using vacuum pressure and induced gas flow from the same vacuum source via a common exit port of the housing.

The vacuum source may be adapted to induce ambient air to flow into and through the housing as the forward drive gas flow.

The apparatus may include a sensor disposed along the dispensing flow path to detect articles passing along the dispensing flow path.

According to method embodiments of the present invention, a method for dispensing solid articles includes providing an apparatus including: a housing defining a hopper chamber to hold the articles and a dispensing channel fluidly connected to the hopper chamber, the dispensing channel having an inlet and an outlet defining a dispensing flow path therebetween; and at least one vacuum source. The method further includes, using the vacuum source, providing a vacuum pressure and inducing a gas flow in the housing; and generating a forward drive gas flow from the vacuum pressure and induced gas flow such that the forward drive gas flow conveys articles through the dispensing channel along the dispensing flow path in a direction from the inlet to the outlet to dispense the articles.

According to some embodiments, the apparatus includes an expansion region downstream of the outlet along the dispensing flow path, and the method includes, using the forward drive gas flow, conveying the articles through the dispensing channel and into the expansion region where the velocity of the forward drive gas flow is reduced and the articles decouple from the forward drive gas flow to be dispensed. The method may further include generating a reverse drive gas flow from the vacuum pressure and induced gas flow such that the reverse drive gas flow conveys articles through the dispensing channel along the dispensing flow path in a direction from the outlet to the inlet to return the articles to the hopper chamber. In some embodiments, the housing includes a dispensing portal, the apparatus includes a gate system including a gate member positioned in the dispensing pathway, and the method further includes: positioning the gate member in an open position wherein the gate member permits the articles to pass through the portal; and thereafter positioning the gate member in a closed position wherein the gate member blocks the articles from passing through the portal.

The method may include generating an agitation gas flow from the vacuum pressure and induced gas flow such that the agitation gas flow agitates articles in the hopper chamber.

According to some embodiments, the articles are pharmaceutical articles.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
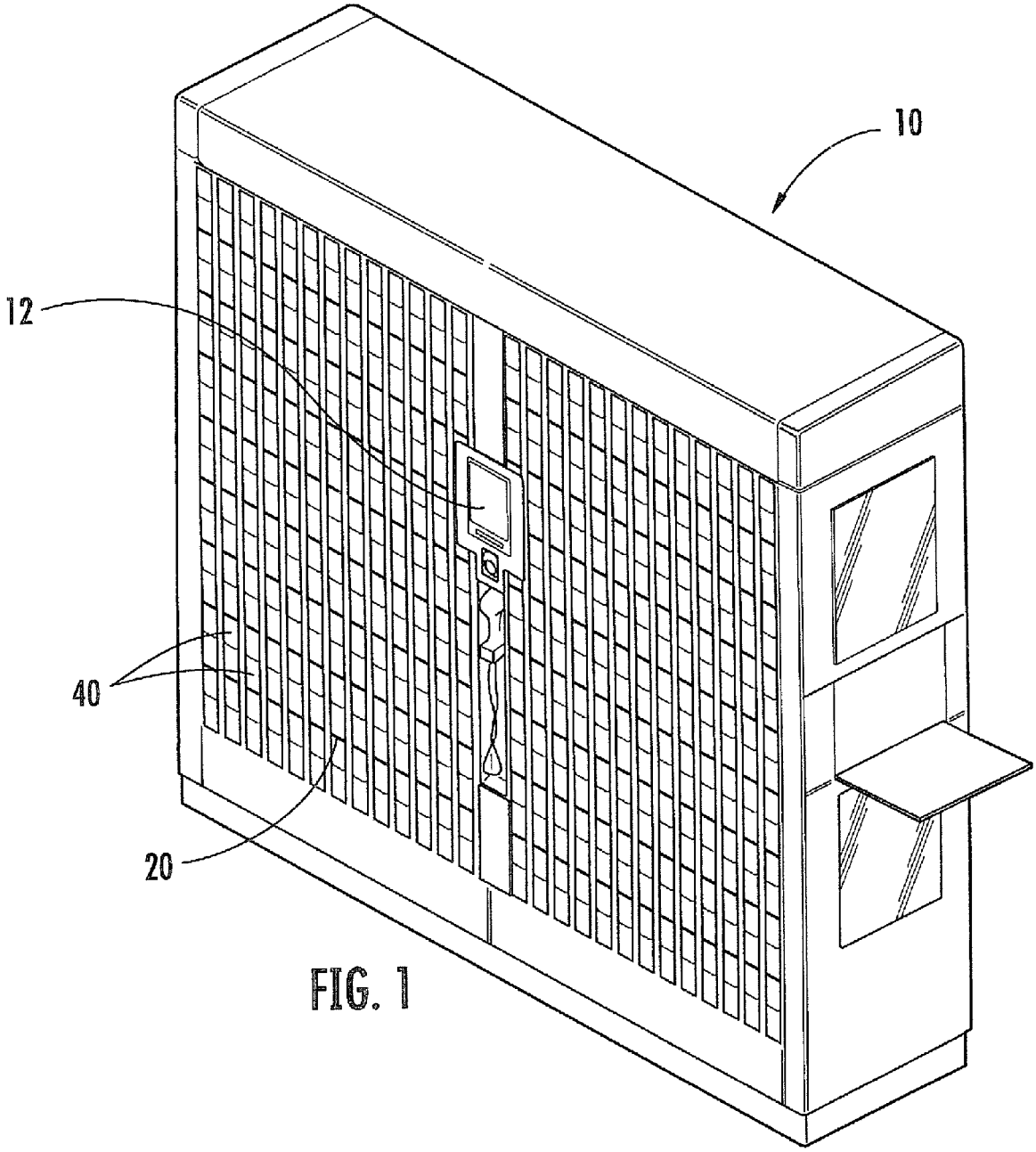
FIG. 1 is a front perspective view of a pharmaceutical tablet dispensing system according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In accordance with embodiments of the present invention, apparatus and methods are provided for dispensing solid articles. According to some embodiments, the solid articles are solid pharmaceutical articles. In particular, such methods and apparatus may be used to dispense pharmaceutical pills or tablets.

According to embodiments of the invention, a vacuum-driven article dispensing apparatus for dispensing articles includes a housing and a vacuum source fluidly connected to the housing. The housing defines a chamber to hold the articles and a dispensing channel fluidly connected to the chamber. The dispensing channel has an inlet and an outlet defining a flow path therebetween. The vacuum source is adapted to provide a vacuum pressure and induce a gas flow in the housing. The apparatus is configured to generate a forward drive gas flow from the vacuum pressure and induced gas flow, wherein the forward drive gas flow conveys the articles through the dispensing channel along the flow path in a direction from the inlet to the outlet to dispense the articles. According to some embodiments, the apparatus is further configured to generate a reverse drive gas flow from the vacuum pressure and induced gas flow, wherein the reverse drive gas flow conveys the articles through the dispensing channel along the flow path in a direction from the outlet to the inlet to return the articles to the chamber. The vacuum source may induce the ambient air to flow into and through the housing as the forward and reverse drive gas flows.

Figure 2:
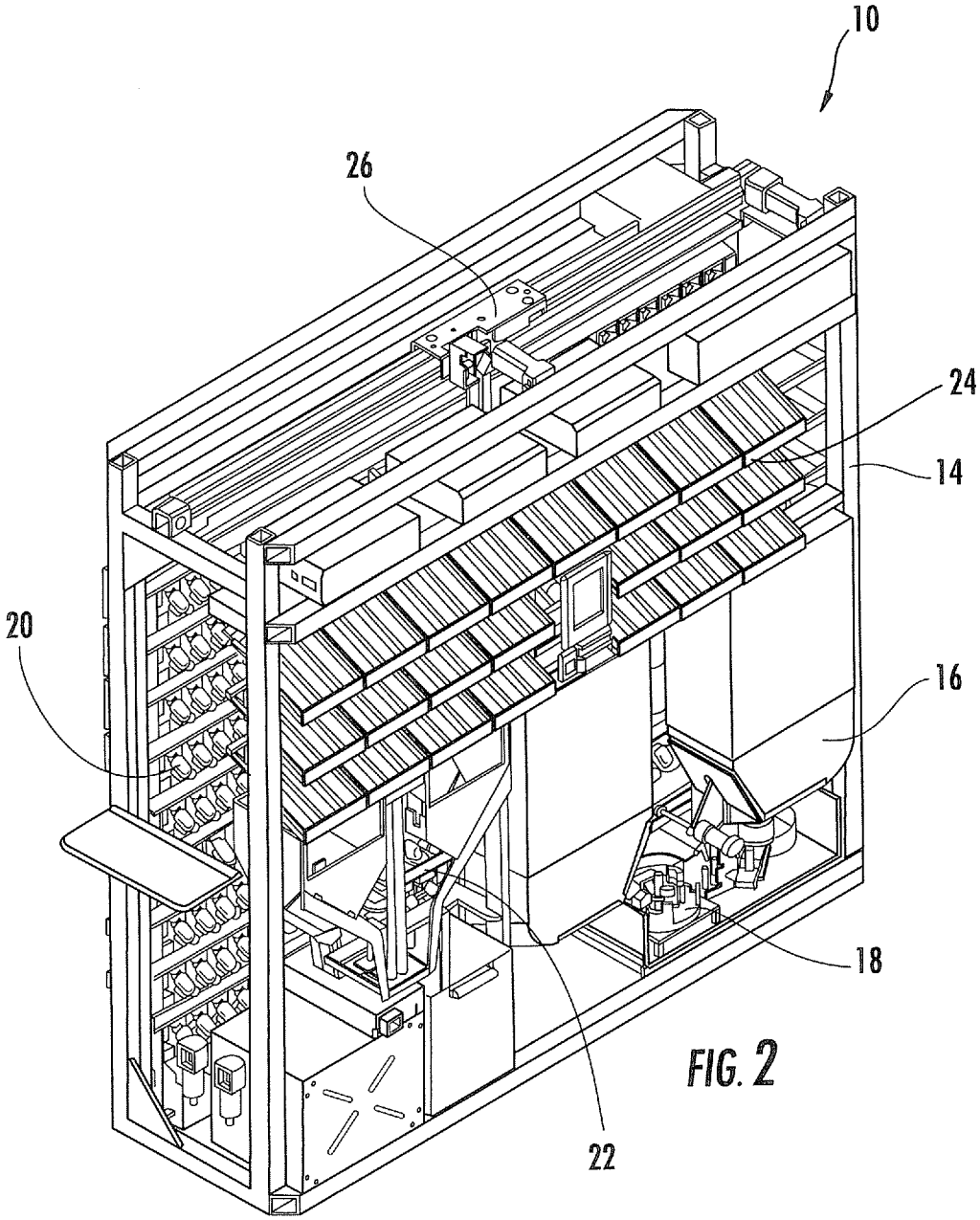
FIG. 2 is a cutaway, rear perspective view of the tablet dispensing system of FIG. 1.
Figure 3:
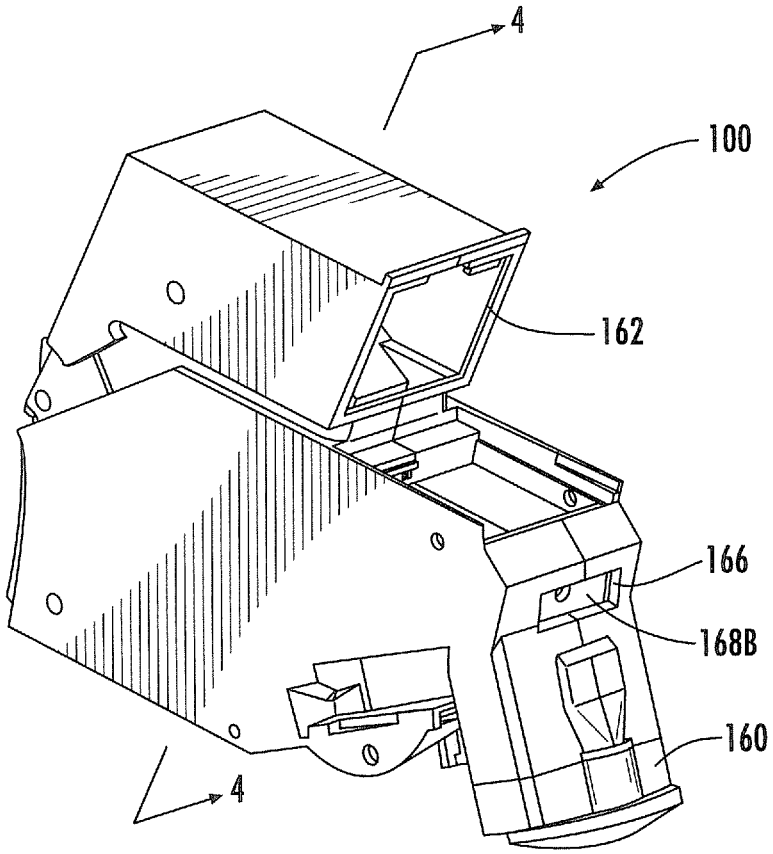
FIG. 3 is a top, front perspective view of a dispensing bin according to embodiments of the present invention and forming a part of the tablet dispensing system of FIG. 1.

A dispensing system according to embodiments of the present invention and that can carry out the foregoing methods is illustrated in FIGS. 1-8 and designated broadly therein at 10 (FIGS. 1 and 2). The dispensing system 10 includes a support frame 14 for the mounting of its various components. Those skilled in this art will recognize that the frame 14 illustrated herein is exemplary and can take many configurations that would be suitable for use with the present invention. The frame 14 provides a strong, rigid foundation to which other components can be attached at desired locations, and other frame forms able to serve this purpose may also be acceptable for use with this invention.

The system 10 generally includes as operative stations a controller (represented herein by a graphical user interface 12), a container dispensing station 16, a labeling station 18, a tablet dispensing station 20, a closure station 22, and an offloading station 24. In the illustrated embodiment, containers, tablets and closures are moved between these stations with a dispensing carrier 26; however, in some embodiments, multiple carriers are employed. The dispensing carrier 26 has the capability of moving the container to designated locations within the flame 14. Except as discussed herein with regard to the dispensing station 20, each of the operative stations and the conveying devices may be of any suitable construction such as those described in detail in U.S. Pat. No. 6,971,541 to Williams et al., U.S. Pat. No. 7,344,049, and U.S. patent application Ser. Nos. 11/599,526; 11/599,576; and 11/679,850, the disclosures of which are hereby incorporated herein in their entireties.

The controller 12 controls the operation of the remainder of the system 10. In some embodiments, the controller 12 will be operatively connected with an external device, such as a personal or mainframe computer, that provides input information regarding prescriptions. In other embodiments, the controller 12 may be a stand-alone computer that directly receives manual input from a pharmacist or other operator. The controller 12 may be distributed with a portion thereof mounted on each bin as described hereinbelow. As used herein, the controller 12 may refer to a central controller and/or a dedicated controller onboard an associated bin. An exemplary controller is a conventional microprocessor-based personal computer.

In operation, the controller 12 signals the container dispensing station 16 that a container of a specified size is desired. In response, the container dispensing station 16 delivers a container to the labeling station 18. The labeling station 18 includes a printer that is controlled by the controller 12. The printer prints and presents an adhesive label that is affixed to the container. The carrier 26 moves the labeled container to the appropriate bin 40 for dispensing of tablets in the container.

Filling of labeled containers with tablets is carried out by the tablet dispensing station 20. The tablet dispensing station 20 comprises a plurality of tablet dispensing bin assemblies or bins 100 (described in more detail below), each of which holds a bulk supply of individual tablets (typically the bins 100 will hold different tablets). Referring to FIGS. 3-8, the dispensing bins 100, which may be substantially identical in size and configuration, are organized in an array mounted on the rails of the frame 14. Each dispensing bin 100 has a dispensing passage or channel 140 that communicates with a portal or outlet 160B that faces generally in the same direction to create an access region for the dispensing carrier 26. The identity of the tablets in each bin is known by the controller 12, which can direct the dispensing carrier 26 to transport the container to the proper bin 100. In some embodiments, the bins 100 may be labeled with a bar code, RFID tag or other indicia to allow the dispensing carrier 26 to confirm that it has arrived at the proper bin 100.

The dispensing bins 100 are configured to singulate, count, and dispense the tablets contained therein, with the operation of the bins 100 and the counting of the tablets being controlled by the controller 12. Some embodiments may employ the controller 12 as the device which monitors the locations and contents of the bins 100; others may employ the controller 12 to monitor the locations of the bins, with the bins 100 including indicia (such as a bar code or electronic transmitter) to identify the contents to the controller 12. In still other embodiments, the bins 100 may generate and provide location and content information to the controller 12, with the result that the bins 100 may be moved to different positions on the frame 14 without the need for manual modification of the controller 12 (i.e., the bins 100 will update the controller 12 automatically).

Figure 4:
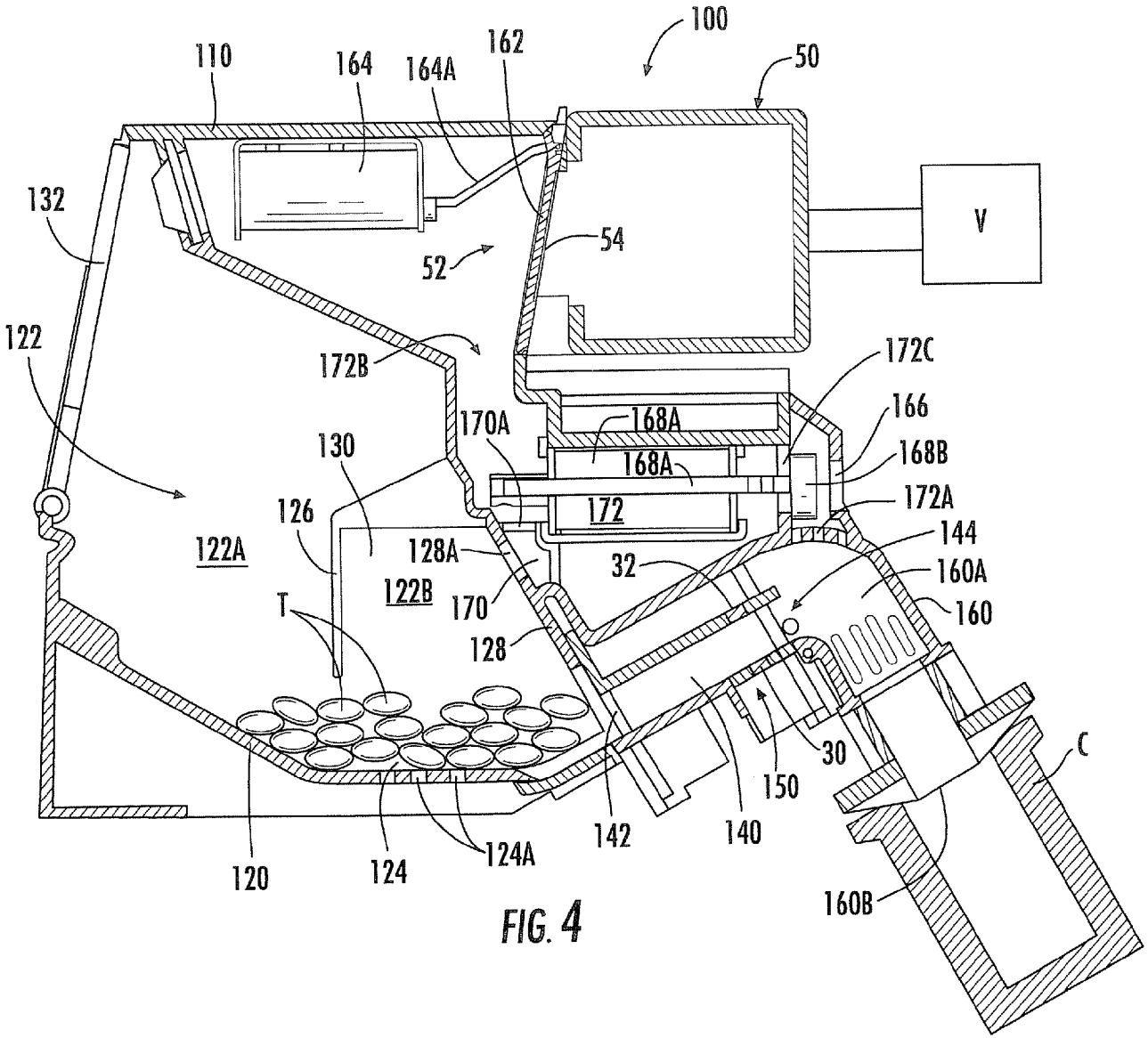
FIG. 4 is a cross-sectional view of the dispensing bin of FIG. 3 taken along the line 4-4 of FIG. 3 and a vacuum manifold and a vacuum source also forming parts of the tablet dispensing system of FIG. 1.
Figure 5:
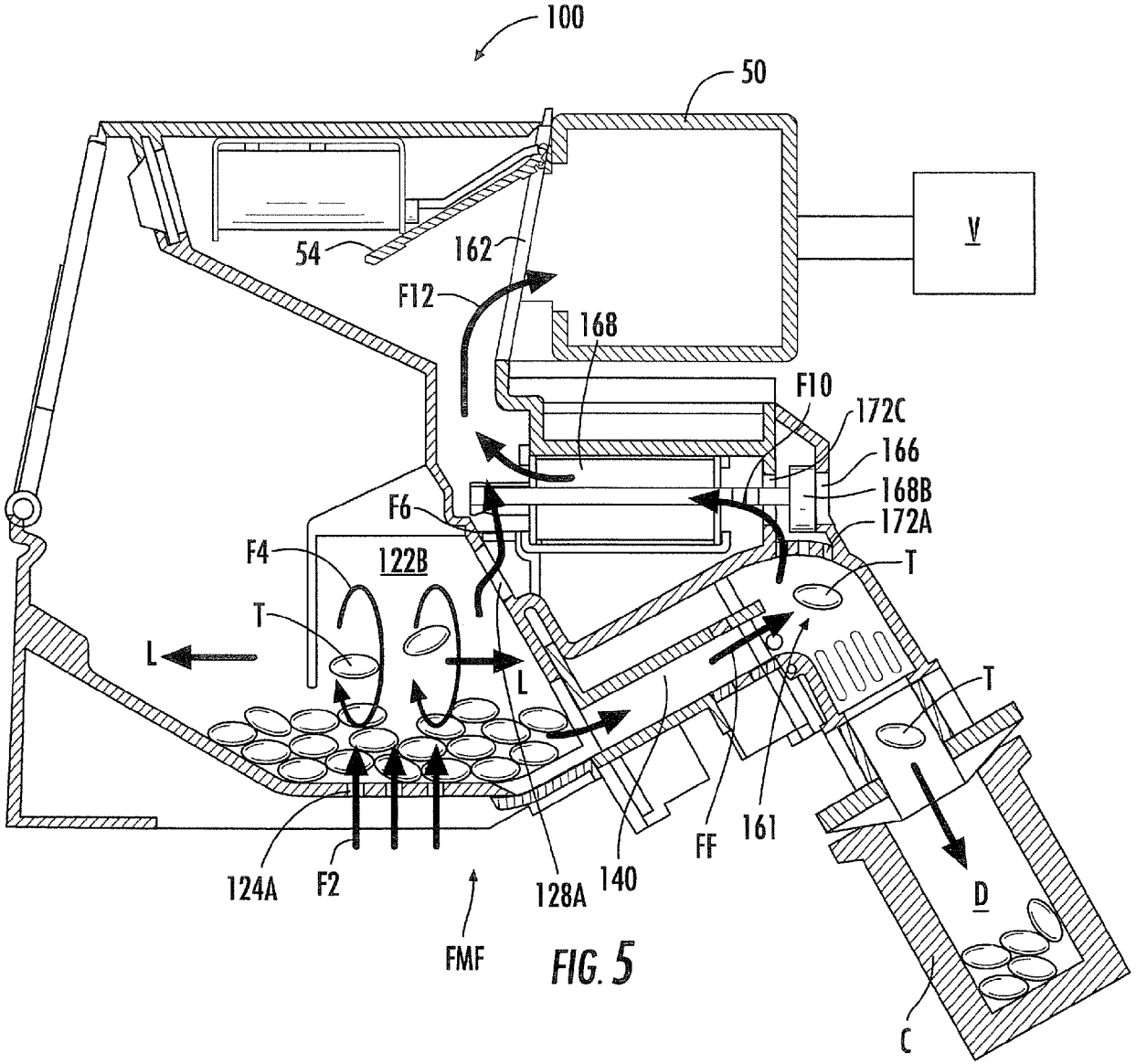
FIG. 5 is a cross-sectional view of the dispensing bin of FIG. 3 in a forward flow mode.
Figure 6:
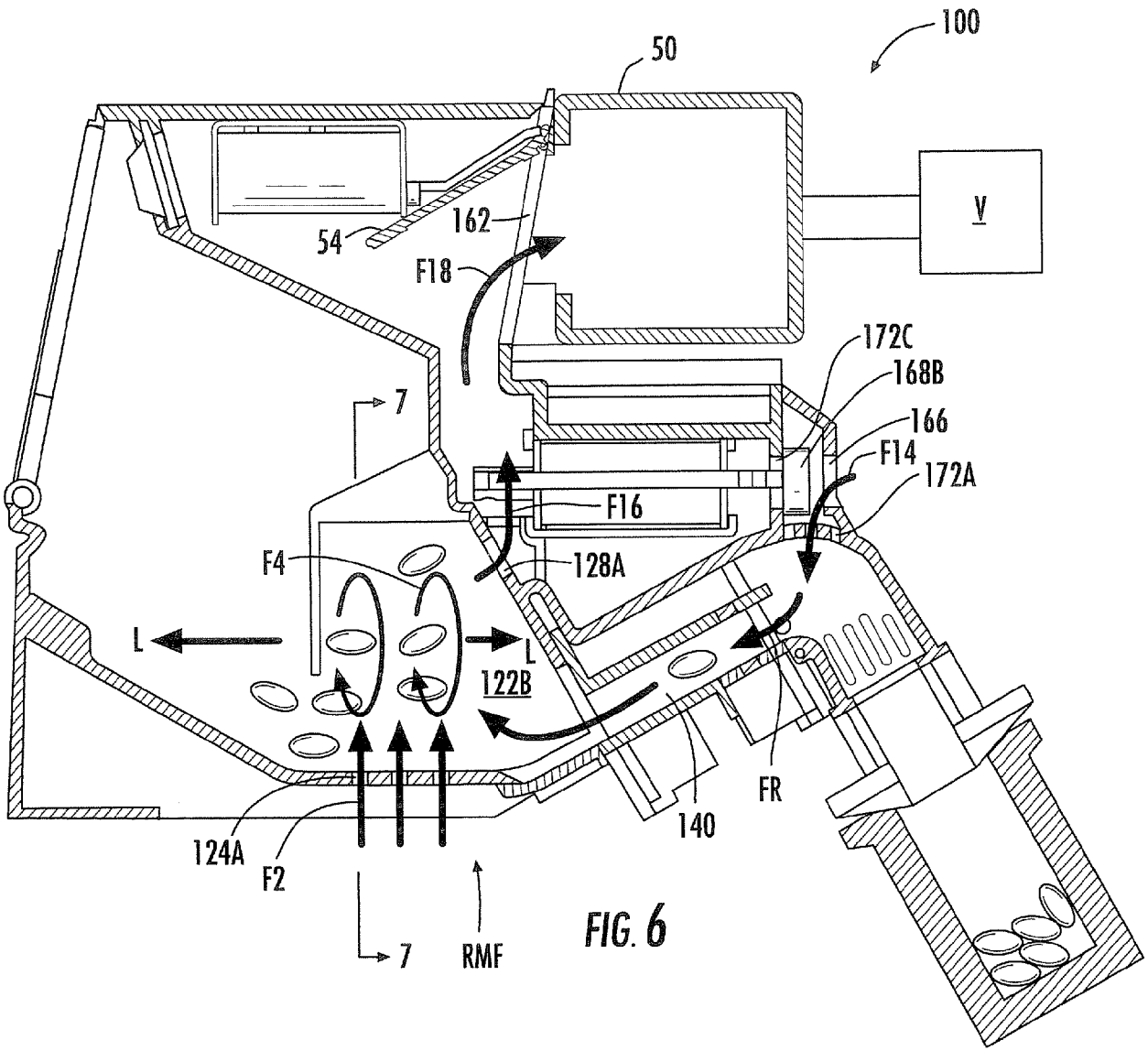
FIG. 6 is a cross-sectional view of the dispensing bin of FIG. 3 in a reverse flow mode.

The tablet dispensing station 20 further comprises a vacuum manifold 50, fitting, flexible or rigid conduit, or the like (FIGS. 4-6). The vacuum manifold 50 has a number of inlets 52 and may be mounted on the frame 14. The vacuum manifold 50 is fluidly connected to a vacuum source V such as a vacuum generator. The vacuum source V provides suction (i.e., a negative pressure and vacuum flow) to the bin 100, as discussed below.

After the container is desirably filled by the tablet dispensing station 20, the dispensing carrier 26 moves the filled container to the closure dispensing station 22. The closure dispensing station 22 may house a bulk supply of closures and dispense and secure them onto a filled container. The dispensing carrier 26 then moves to the closed container, grasps it, and moves it to the offloading station 24.

Turning to the bins 100 in more detail, an exemplary bin 100 is shown in more detail in FIGS. 3-8. The bin 100 includes a housing 110 having a hopper portion 120 and a nozzle 160. The bin 100 is fluidly connected with a vacuum source V (FIGS. 4-6).

The hopper portion 120 defines a hopper chamber 122 that can be filled with tablets T. The bin 100 can be filled or replenished with tablets through an opening located at the upper rear portion of the bin 100. The opening is selectively accessible via a pivoting door 132, for example, that normally resides in a closed position as shown in FIG. 4 and which can be pivoted open to access the opening.

The tablets T can be dispensed one at a time into the container C (FIGS. 4-6) through the dispensing channel 140. The dispensing channel 140 has an inlet 142 adjacent and fluidly connecting the channel 140 to the hopper chamber 122. The dispensing channel 140 includes an outlet 144 downstream from and opposite the inlet 142 and through which tablets may exit to be dispensed into the container C. The bin 100 defines a tablet dispensing path from the inlet 142, through the dispensing channel 140, through the outlet 144, and through the nozzle 160. According to some embodiments and as illustrated, the dispensing channel 140 is uniformly rectangular in cross-section from the inlet 142 to the outlet 144.

The hopper portion 120 has a bottom wall defining a floor 124. The floor 124 has a sloped rear portion that slopes downwardly toward the inlet 142. The floor 124 may also have a funnel-shaped front portion. Openings 124A extend through the floor 124. As discussed below, air or other gas can be induced to flow through the openings 124A (e.g., from the ambient environment) and into the hopper chamber 122 to agitate the tablets T contained therein. According to some embodiments, the openings 124A extend at an angle A1 (FIG. 7) with respect to the floor surface 124 that is selected to provide tangential or nearly tangential air flow with respect to the floor surface 124. According to some embodiments, the angle A1 is in the range of from about 5 to 35 degrees.

Figure 7:
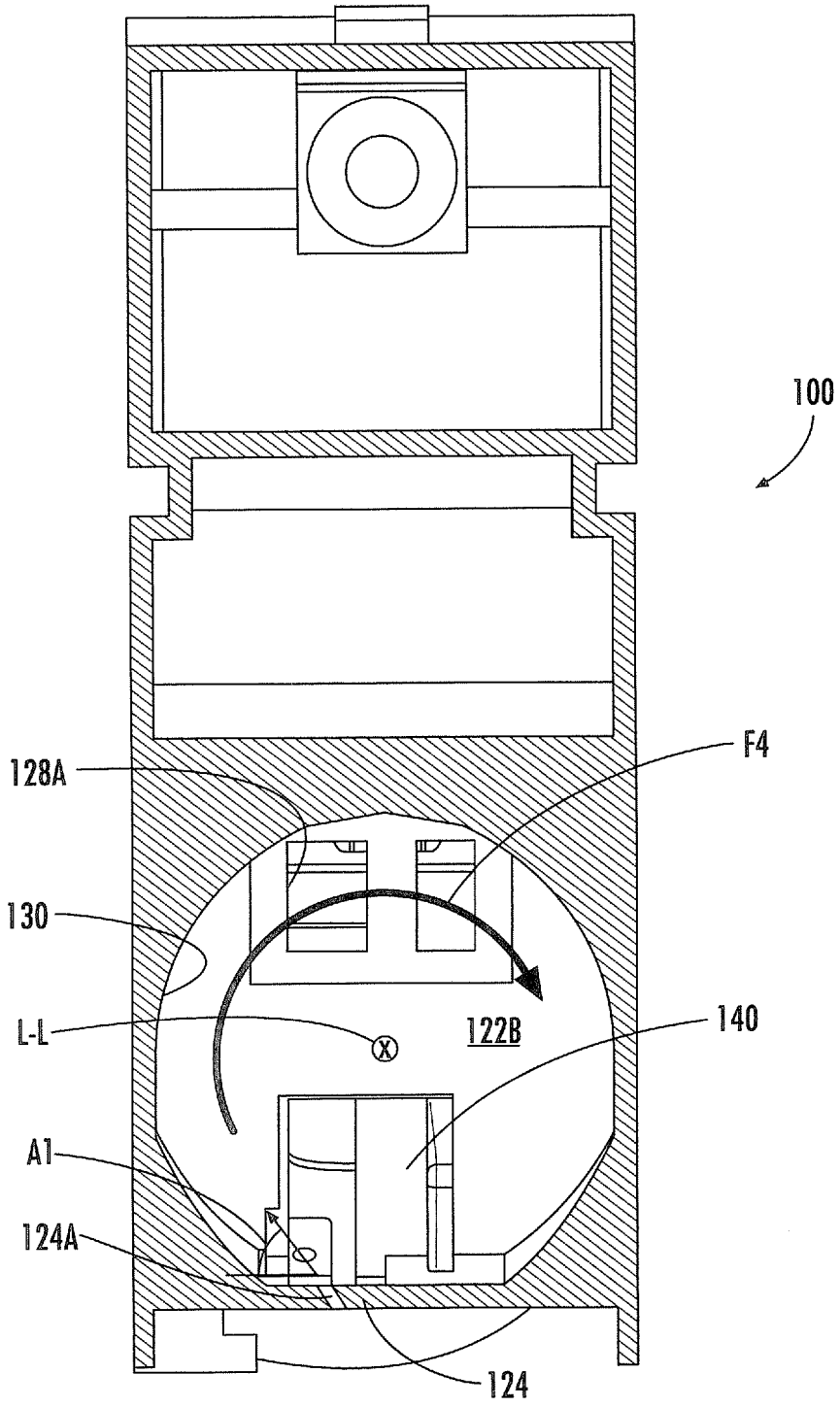
FIG. 7 is a cross-sectional view of the dispensing bin of FIG. 3 taken along the line 7-7 of FIG. 6.
Figure 8:
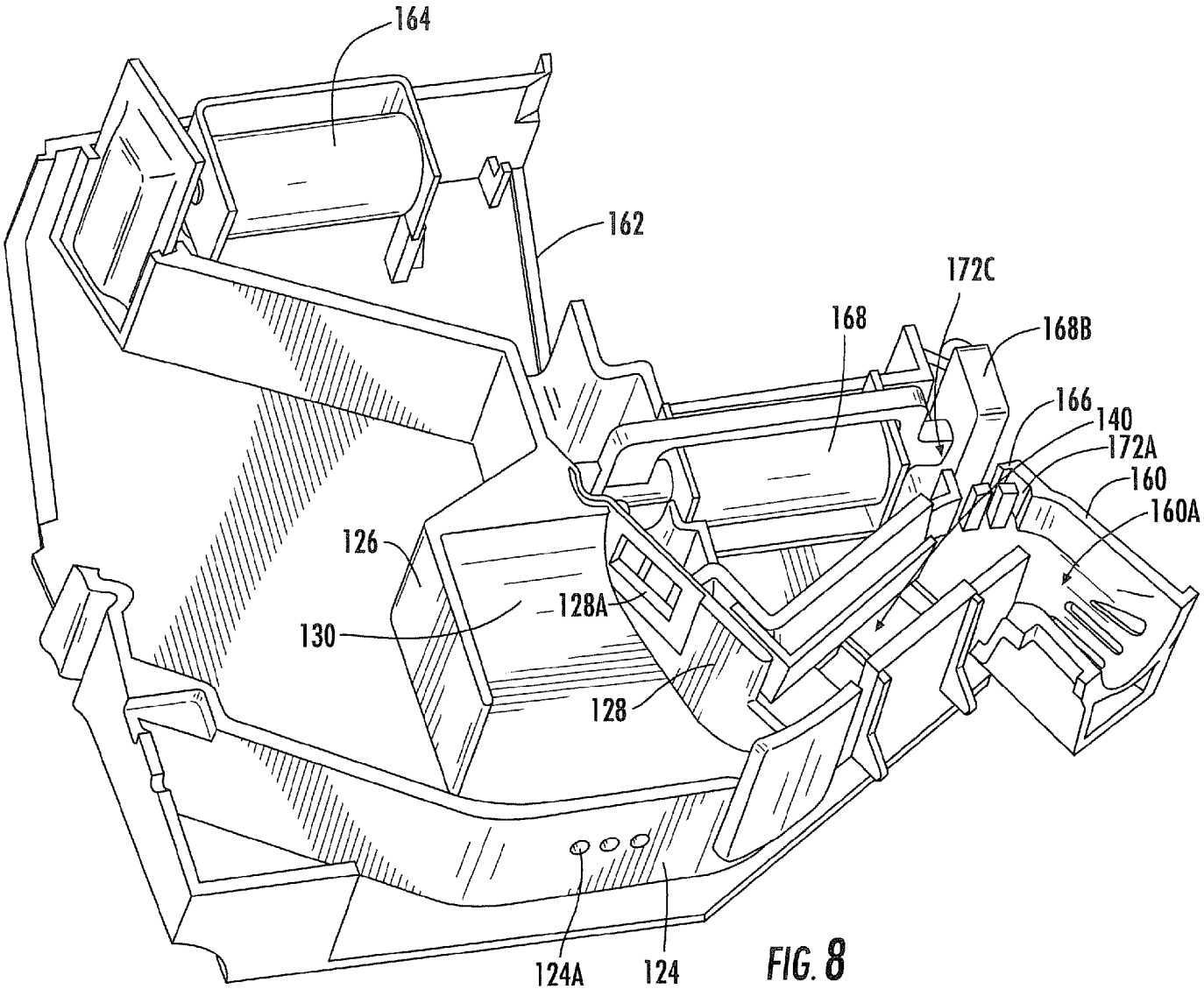
FIG. 8 is a fragmentary, bottom, rear perspective view of the dispensing bin of FIG. 3.

A partition or divider wall 126 extends through the hopper chamber 122 and divides the chamber 122 into a rear subchamber 122A and a front subchamber 122B. The wall 126 may also form a gap or choke point as described in U.S. patent application Ser. No. 11/750,710, filed May 18, 2007, the disclosure of which is incorporated herein by reference. More than one partition wall may be provided. The front subchamber 122B is further defined by a front wall 128 and a curved or arcuate side wall 130 (FIGS. 4 and 7). According to some embodiments, the side wall 130 has a radius of curvature in the range of from about 0.5 to 2 inches and, according to some embodiments, the radius is about half the width of the hopper chamber 122, in order to provide a continuous curvature of the front subchamber 122B. A vent or opening 128A is defined in the front wall 128.

The bin 100 further includes an adjustable dispensing channel subassembly 150, only a portion of which is shown in the drawings. The adjustable dispensing channel subassembly 150 may be configured as disclosed in co-assigned U.S. Published Patent Application No. US-2008-0283734-A1, the disclosure of which is incorporated herein by reference. According to some embodiments, the heightwise and widthwise dimensions of the dispensing channel 140, the inlet 142, and the outlet 144 can be selectively configured using the adjustment mechanisms of the adjustable dispensing channel subassembly 150.

According to some embodiments, the bin 100 includes a sensor system including one or more radiation detectors (e.g., photodetectors) and radiation emitters (e.g., photoemitters). An exemplary photodetector 30 and photoemitter 32 are shown in FIG. 4. According to some embodiments, the bin 100 includes a sensor system as disclosed in Applicants' U.S. Published Patent Application No. US-2008-0283734-A1.

The photodetector(s) may be configured and positioned to detect the tablets T as they pass through the dispensing channel 140. The photodetector(s) can be configured to generate detector signals that are proportional to the light received thereby. The photoemitter(s) may be positioned and configured to generate light that is directed toward the photodetector(s) across the dispensing pathway of the tablets T. In this manner, when a tablet T interrupts the light transmitted from the photoemitter to the photodetector, the detector signal will change based on the reduced light being received at the respective photodetector. According to some embodiments, the controller 12 uses detection signals from the photodetector to count the dispensed tablets, to assess a tablet or tablets, and/or to determine conditions or performance in tablet dispensing. In some cases, the sensor system operates the solenoids 164, 168 or other devices in response to identified or determined count, conditions or performance in dispensing.

The nozzle 160 defines a through passage 160A and communicates with the outlet 144 and the nozzle outlet 160B.

A vacuum port 162 is located on the front of the housing 110. When the bin 100 is installed in the frame 14, the port 162 is sealingly mated with the inlet 52 of the vacuum manifold 50. A solenoid 164 having a shaft 164A is positioned adjacent the vacuum port to engage the door 54 of the vacuum manifold 50 to selectively open and close the inlet 52.

A control port or front intake opening 166 is defined in the housing 110 above the nozzle 160. A piston 168A having a head 168B is selectively driven by a solenoid 168 between an extended position as shown in FIG. 5, wherein the head 168B closes the opening 166 and opens an opening 172C, and a retracted position as shown in FIG. 6, wherein the head 168B opens the opening 166 and closes the opening 172C.

A plenum 170 is defined in the bin 100 on the front wall 128 opposite the subchamber 122B. The plenum 170 communicates with the opening 128A and an opening 170A.

A passage 172 is defined in the housing 110 and may contain the solenoid 168. The passage 172 fluidly communicates with the dispensing passage 140 via a vent or opening 172A and opening 172C and with the vacuum port 162 via an opening 172B.

Exemplary operation of the dispensing system 10, including more particular operation of the bin 100, will now be described. The bin 100 is filled with tablets T to be dispensed. The tablets T may initially be at rest as shown in FIG. 4. At this time, the door 54 is closed so that the suction from the vacuum source V is not applied to the bin 100. The piston 168A is in its closed position as shown in FIG. 5 so that the intake opening 166 is closed.

If necessary, the adjustable dispensing channel subassembly 150 is suitably adjusted to provide the dispensing channel 140 and/or the inlet 142 with the appropriate dimensions for singulating the intended tablets T.

When the bin 100 is first activated for dispensing, the solenoid 164 is actuated to open the door 54 to fluidly couple the bin 100 to the vacuum source V. The vacuum source V is thereby placed in fluid communication with the vacuum port 162 via the manifold 50. According to some embodiments, the pressure of the vacuum at the port 162 is less than about −2 psi and, according to some embodiments, in the range of from about −0.5 to −5 psi. At this time, the opening 166 is opened and remains open (and the opening 172C remains closed) by maintaining the solenoid 168 in its unenergized state so that the piston 168A is retracted by the vacuum, for example, as shown in FIG. 6. According to other embodiments, the controller 12 may cause the solenoid 168 to actively retract the piston 168A.

The suction from the vacuum source V applies a negative pressure to the bin 100 to generate a reverse mode flow configuration RMF as shown in FIG. 6. The opened intake opening 166 permits the vacuum source V to draw or induce an intake flow F14 of ambient air through the opening 166 and then through the opening 172A. The vacuum further causes or induces a flow F2 of ambient air to flow into the subchamber 122B through the floor openings 124A. Owing to the angled orientation of the openings 124A and the arcuate or cylindrical shape of the side wall 130, the flow F2 is converted to a vortex flow F4 that swirls or circulates about a lengthwise axis as show in FIGS. 6 and 7 (which is a cross-sectional view taken along the line 7-7 of FIG. 6). The vortex flow F4 lofts or otherwise displaces (i.e., agitates) the tablets T in the hopper subchamber 122B proximate the inlet 142. A portion of the flow F2 continues as an agitation return flow F16 through the front wall opening 128A, into the plenum 170, through the opening 170A to the passage 172, and as an exit flow F18 through the opening 172B and the port 162 to the vacuum source V. At this time, no tablets T are conveyed in either direction through the dispensing passage 140. This may be referred to as an "idle" mode or state and may be continued until the container C is brought into position against the nozzle 160 to be filled.

When it is desired to dispense the tablets T to fill the container C, the dispensing carrier 26, directed by the controller 12, moves the container C to the exit port 160B of the nozzle 160 of the selected dispensing bin 100. Once the container C is properly positioned, the controller 12 actuates the solenoid 168 to extend the piston 168A to close the opening 166 (and open the opening 172C) as shown in FIG. 5.

The suction from the vacuum source V continues to apply a negative pressure to the bin 100 to generate a forward mode flow configuration FMF as shown in FIG. 5. More particularly, the vacuum continues to cause or induce the flow F2 of ambient air to flow into the subchamber 122B through the floor openings 124A to agitate the tablets T in the subchamber 122B as described above. A portion of the flow F2 continues as an agitation return flow F6 through the front wall opening 128A, into the plenum 170, and through the opening 170A to the passage 172.

Another portion of the induced flow F2 flows through the dispensing passage 140 as a high velocity forward dispensing flow FF. The flow FF passes through the dispensing passage 140 and over the upper end of the nozzle passage 160A. The forward dispensing flow FF entrains and forces or drives the tablets T through the dispensing passage 140. At the top of the nozzle passage 160A, the tablets T are decoupled from the dispensing flow FF due to the expanded volume in an expansion chamber or region 161 (FIG. 5) of the nozzle passage 160A as compared to the dispensing passage 140. This expansion region 161 causes a flow velocity drop which releases the tablets T toward the container C in a dispensing direction D as shown in FIG. 5. The physical geometry of this region may also serve to guide the tablets toward the container C. The tablets T are oriented into a preferred orientation and singulated by the shape of the inlet 142. The photodetectors detect the tablets T as they pass through respective predetermined points in the dispensing channel 140.

The flow FF continues on through the openings 172A, 172C as a forward return flow F10. The forward return flow F10 passes through the passage 172 and combines with the agitation return flow F6 to form an exit flow F12. The exit flow F12 continues through the opening 172B and the port 162 to the vacuum source V.

Once dispensing is complete (i.e., a predetermined number of tablets has been dispensed and counted), the controller 12 releases the solenoid 168, thereby permitting the vacuum pressure to move the piston 168A inward to open the intake opening 166 (and close the opening 172C) to again generate the reverse mode flow configuration RMF as shown in FIG. 6. According to other embodiments, the controller 12 may cause the solenoid 168 to actively retract the piston 168A. The opened intake opening 166 permits the vacuum source V to draw or induce an intake flow F14 of ambient air through the opening 166 and then through the opening 172A. The intake flow F14 continues to provide a high velocity reverse flow FR inwardly through the dispensing passage 140 and into the hopper subchamber 122B. In this manner, the airflow is reversed and any tablets T remaining in the channel 140 are returned to the subchamber 122B under the drive force of the reverse flow FR (FIG. 6).

The vacuum source V also continues to draw the flow F2 through the floor openings 124A to provide the vortex flow F4. The flow FR combines with the flow F2 into a return flow F16 through the openings 128A, 170A and an exit flow F18 through the opening 172B and the port 162 to the vacuum source V.

According to some embodiments, the operation of the system 10 may be modified or executed as follows. Initially, the door 54 is closed so that the suction from the vacuum source V is not applied to the bin 100. The piston 168A is in its closed position as shown in FIG. 5 so that the intake opening 166 is closed. When it is desired to dispense the tablets T to fill the container C, the dispensing carrier 26, directed by the controller 12, moves the container C to the exit port 160B of the nozzle 160 of the selected dispensing bin 100. The controller 12 then signals the solenoid 164 to open the door 54. The vacuum source V is thereby placed in fluid communication with the vacuum port 162 via the manifold 50. As a result, the flows FMF, F2 and FF are generated as described above to agitate the tablets T in the subchamber 122B and to forwardly dispense the tablets T through the dispensing channel 140.

During a dispensing cycle (i.e., when the forward flow FF is being generated), the controller 12 may determine that a tablet jam condition is or may be present. A tablet jam is a condition wherein one or more tablets are caught up in the bin 100 such that tablets T will not feed into or through the dispensing channel 140 under the pass of the forward flow FF. Tablets may form a jam at the nozzle inlet 142 or elsewhere so that no tablets are sensed passing through the dispensing passage 140 for a prescribed period of time while the forward air flow FF is being generated. When a tablet jam is identified by the controller 12, the controller 12 will issue a "jam clear" or "backjet" by the solenoid 168 (i.e., open the intake opening 166) as described above for generating the reverse air flow FR and the agitation flows F2, F4 to clear a perceived tablet jam. These air flows may serve to dislodge any such jams as well as to loosen the tablets in the hopper chamber 122.

While, in the foregoing description, the controller 12 controls the solenoids 164, 168, one or both of the solenoids 164, 168 may alternatively be controlled by a local controller unique to each bin 100. Other types of actuators may be used in place of one or both of the solenoids 164, 168.

Typically, an operator will request that a desired number of tablets be dispensed ("the requested count"). The sensor system can detect the tablets T as they pass through predetermined points in the dispensing channel 140. The controller 12 may use the detection signals from the photodetectors to monitor and maintain a registered count of the tablets T dispensed ("the system count"). When the system count matches the requested count, the controller 12 will deem the dispensing complete and cease dispensing of the tablets T by opening the intake opening 166 and/or closing the vacuum manifold door 54.

From the foregoing description, it will be appreciated that the bin 100 is a vacuum driven article dispenser that uses only vacuum pressure-induced flow to dispense, reverse and agitate the tablets therein. As a result, only a single pressure and flow source (i.e., the vacuum source) is required for each of these functions.

Methods and apparatus as described herein may provide a number of advantages. Each of the forward mode flow FMF (FIG. 5) and the reverse mode flow RMF (FIG. 6) applies a vacuum pressure to the nozzle outlet 160B that serves to draw and seal the container C against the nozzle 160. In this manner, the bin 100 may prevent tablets T from escaping between the nozzle 160 and the container C. Also, if a container C is not present to form the seal at the nozzle outlet 160B, the bin 100 will not dispense tablets T.

The bin 100 and system 10 are further advantageous in that gas (e.g., air) is only drawn into the bin 100 from the environment. Gas is not exhausted to the environment. The air drawn from the bin 100 is directed into the vacuum manifold 50 where it may be filtered to remove tablet dust.

The bin 100 automatically adjusts the mass flow rate of the drive gas flows FF, FR proportionally to the cross-sectional area of the dispensing channel 140. The dispensing channel 140 may be sized (e.g., by adjustment) larger for larger tablets T, in which case the bin 100 will inherently provide a greater mass flow rate through the dispensing passage 140 to better convey the heavier tablets.

Because the various airflows for agitation, dispensing and tablet return are all supplied by the vacuum source, it is not necessary to provide a separate high pressure air supply to perform tablet dispensing or reversal. According to some embodiments and as illustrated, the agitation flow F2, the forward dispensing flow FF, the intake flow F14, and the reverse flow FR are each generated by the same vacuum source V. According to some embodiments, each of these flows is generated by the same vacuum source V and exit the bin 100 at the same exit port to the vacuum source V. In this way, the number of vacuum supplies and connections required can be reduced or minimized.

Figure 9:
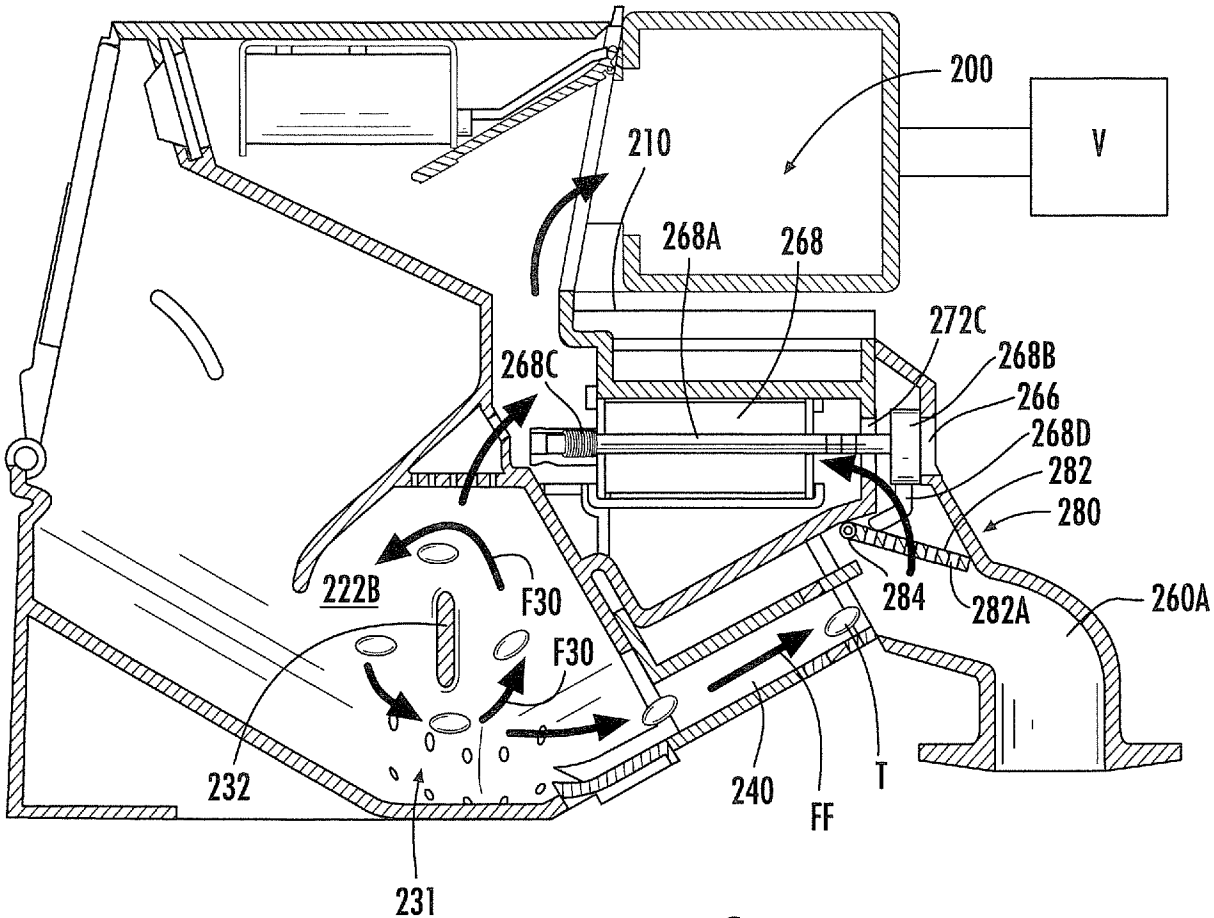
FIG. 9 is a cross-sectional view of a dispensing bin according to further embodiments of the present invention in a forward flow mode.
Figure 10:
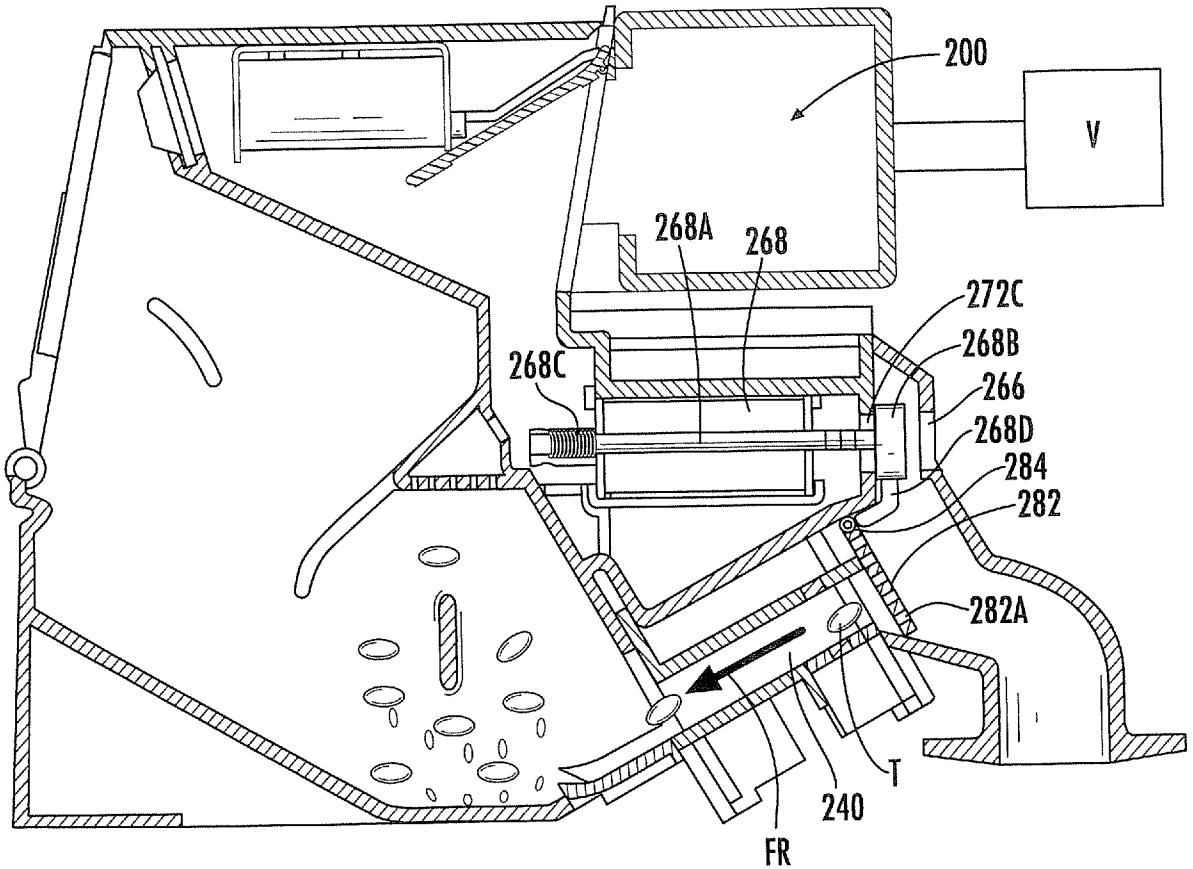
FIG. 10 is a cross-sectional view of the dispensing bin of FIG. 9 in a reverse flow mode.
Figure 11:
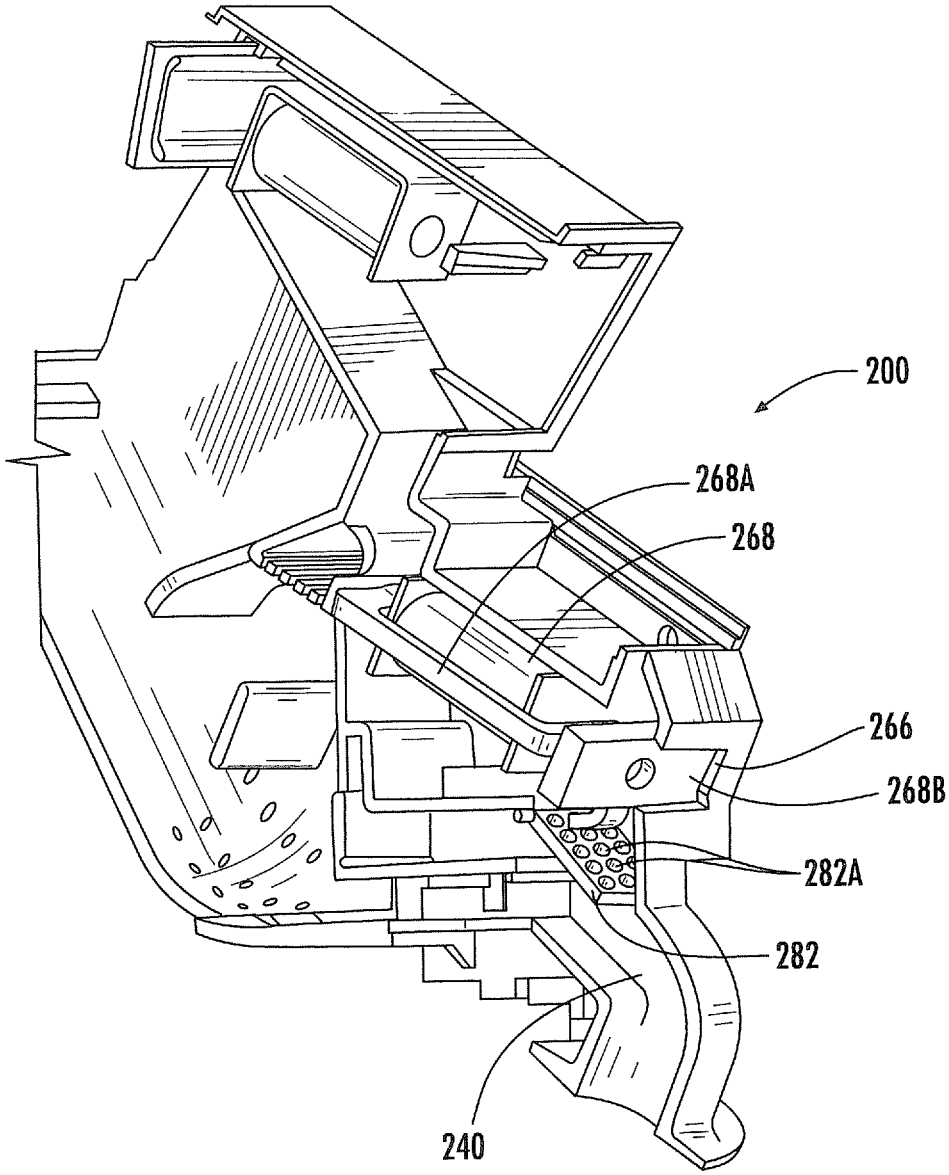
FIG. 11 is a fragmentary, top, front perspective view of the dispensing bin of FIG. 9.

With reference to FIGS. 9-11, a dispensing bin 200 according to further embodiments of the invention is shown therein. The dispensing bin 200 may correspond to the dispensing bin 100 except as discussed below.

In the bin 200, a spring 268C (FIGS. 9 and 10) is provided to bias the piston 268A rearward or inward to open the intake opening 266 and close the opening 272C. The solenoid 268 can be selectively actuated to drive the piston 268A forward (against the spring force) to close the intake opening 266 and open the opening 272C to generate a forward mode flow configuration FMF as discussed with reference to FIG. 5 to dispense tablets T forwardly. When the solenoid 268 is deactuated, the spring 268C will drive the piston 268A inwardly to generate the reverse flow mode configuration RMF as discussed above with reference to FIG. 6. The spring 268C may provide a more rapid transition from the forward mode flow configuration FMF to the reverse mode flow mode configuration RMF, thereby reducing the risk or occurrence of tablets T being unintentionally dispensed when a dispensing session is terminated.

The bin 200 further includes a gate system 280. The gate system 280 includes a gate 282 pivotally mounted on the housing 210 by a hinge 284. According to some embodiments, the gate member 282 is substantially rigid and includes perforations 282A (FIG. 11). The piston 268A includes an actuator arm 268D secured to the head 268B of the piston 268A for reciprocating movement therewith.

When the piston 268A is in its outward position as shown in FIGS. 9 and 11, the gate member 282 is free to swing forward about the hinge 284 into an open position under the force of forward airflow (i.e., the flow FF of FIG. 4) to permit tablets T to be dispensed through the nozzle passage 260A. The airflow F10 (FIG. 5) can pass through the perforations 282A of the gate member 282. In some embodiments, the perforated gate member 282 when open can serve the function of the perforations of the opening 172A (FIG. 4), which can therefore be omitted.

When the piston 268A is in its inward position as shown in FIG. 10, the actuator arm 268D will engage, drive and hold (or lock) the gate member 282 into a closed position as shown in FIG. 10. In this manner, the gate member 282 can physically block the dispensing of a tablet T from the dispensing passage 240 upon closure of the gate member 282. Closure of the gate member 282 may occur substantially in tandem with the transition from the forward flow mode configuration FMF to the reverse flow mode configuration RMF. The gate system 280 may thereby serve to prevent the unintentional dispensing of a tablet or tablets that would otherwise not be sufficiently reversed by the reverse flow FR (FIG. 6) at the transition.

The gate system 280 may also serve to prevent the tablets T from accidentally dropping out of the bin 200 or being undesirably accessed. The spring 268C biases the piston 268A rearwardly when the solenoid 268 is not powered. As a result, the gate member 282 is maintained in its closed position when the bin 200 is not powered (e.g., when being transported).

With reference to FIG. 9, the bin 200 may also employ an agitation system 231 different from that described with respect to the bin 100. The bin 200 includes a substantially vertical baffle 232 in the subchamber 222B and open at its top and bottom ends. Airflow F30 induced by the vacuum agitates tablets T in the hopper by causing the tablets to move beneath the baffle 232 and down to their starting point as indicated by the arrows. The tablets may recirculate or pass forward to be dispensed. The agitation system 231 may be configured and operate in the same or similar manner to that disclosed in U.S. Pat. No. 7,344,049 to Daniels et al.

Figure 12:
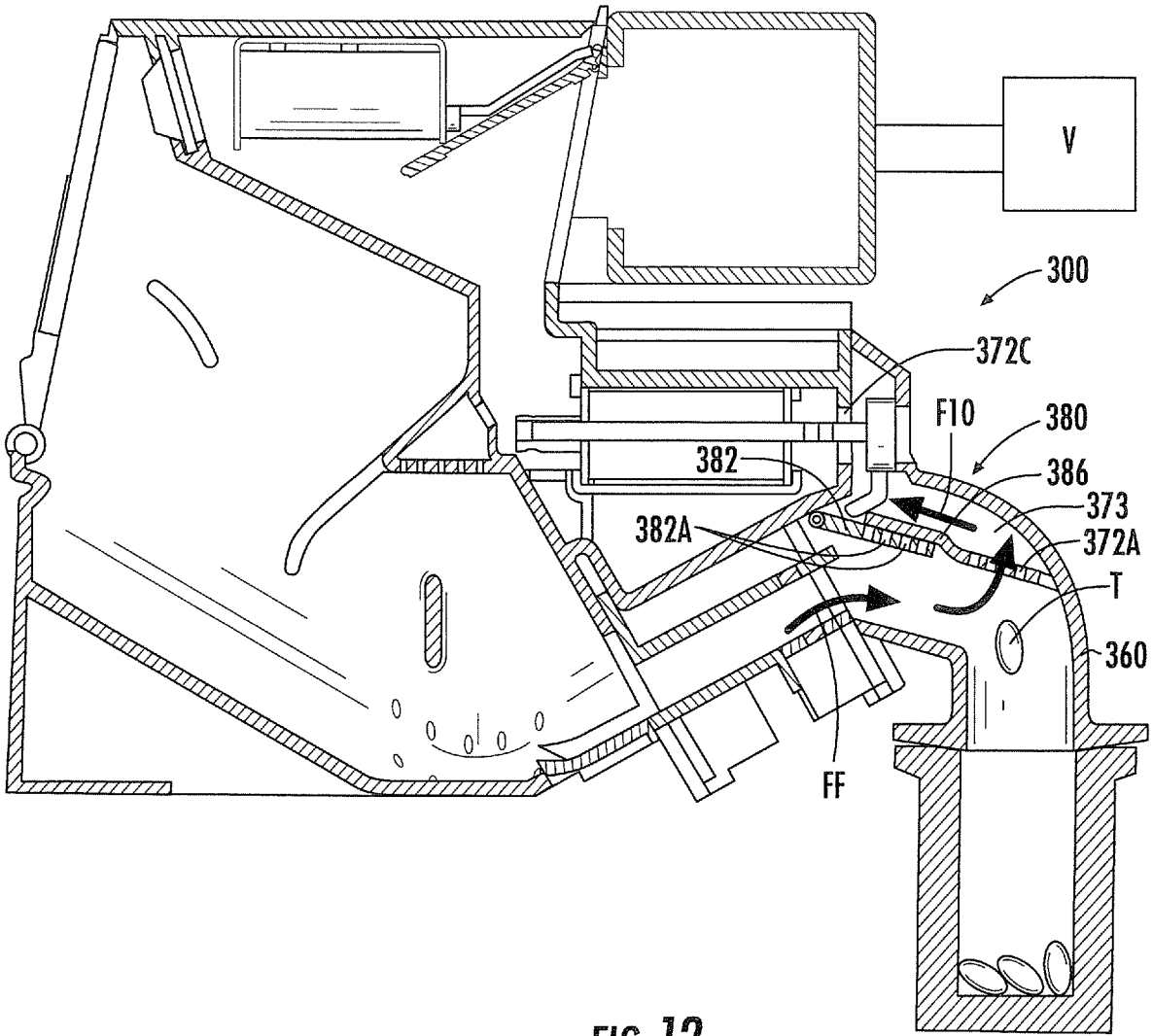
FIG. 12 is a cross-sectional view of a dispensing bin according to further embodiments of the present invention in a forward flow mode.

With reference to FIG. 12, a dispensing bin 300 according to further embodiments of the present invention is shown therein. The dispensing bin 300 may correspond to the dispensing bin 200 except as discussed below.

The bin 300 includes a gate system 380 configured as described above for the gate system 280 except that the gate system 380 further includes a fixed blocking wall 386, a return vent or openings 372A in the nozzle 360, and a return passage 373 fluidly connecting the return opening 372A to the opening 372C.

When the gate 382 (which has perforations 382A) is in the open position as shown in FIG. 12, the perforations 382A are blocked by the wall 386 so that substantially no air flows through the gate 382. Instead, the openings 372A downstream of the gate 382 provide a path for the airflow to leave the dispensing nozzle region and return to the vacuum source V.

The configuration of the bin 300 may be advantageous in that it moves the location of the transition from the forward flow FF to the return flow F10 out of the dispensing region and away from the gate 382. This reduces or eliminates the risk that may otherwise exist that certain tablets will stall or hover in the turbulent transition (which is below the gate 282 in the bin 200), which may cause counting inaccuracies. By moving the transition out from under the gate, this stall or hover phenomenon can be prevented from affecting counting accuracy.

The foregoing is illustrative of the present invention and is not to be construed as limiting thereof. Although a few exemplary embodiments of this invention has been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. An apparatus for dispensing solid articles, the apparatus comprising:

a housing defining a hopper chamber to hold the articles and a dispensing channel fluidly connected to the hopper chamber, the dispensing channel having an inlet and an outlet defining a dispensing flow path therebetween; and at least one vacuum source adapted to provide a vacuum pressure and induce a gas flow in the housing;

wherein the apparatus is configured to generate a forward drive gas flow from the vacuum pressure and induced gas flow, and the forward drive gas flow conveys articles through the dispensing channel along the dispensing flow path in a direction from the inlet to the outlet to dispense the articles;

wherein the apparatus is configured such that the forward drive gas flow flows along the dispensing flow path from the outlet to the vacuum source after passing through the dispensing channel; and wherein the apparatus is configured to generate an agitation gas flow from the vacuum pressure and induced gas flow, wherein the agitation gas flow agitates articles in the hopper chamber.

2. The apparatus of claim 1 including an expansion region downstream of the outlet along the dispensing flow path, wherein the apparatus is configured such that the forward drive gas flow conveys the articles through the dispensing channel and into the expansion region where the velocity of the forward drive gas flow is reduced and the articles decouple from the forward drive gas flow to be dispensed.

3. The apparatus of claim 1 further configured to generate a reverse drive gas flow from the vacuum pressure and induced gas flow, wherein the reverse drive gas flow conveys articles through the dispensing channel along the dispensing flow path in a direction from the outlet to the inlet to return the articles to the hopper chamber.

4. The apparatus of claim 1 configured to generate the agitation gas flow and the forward drive gas flow simultaneously using the vacuum pressure and induced gas flow from the vacuum source.

5. The apparatus of claim 1 including a sensor disposed along the dispensing flow path to detect articles passing along the dispensing flow path.

6. The apparatus of claim 1 wherein:

the at least one vacuum source is adapted to induce ambient air to flow into and through the housing as the forward drive gas flow;

the apparatus is configured to generate the agitation gas flow and the forward drive gas flow simultaneously using vacuum pressure and induced gas flow from the same vacuum source via a common exit port of the housing; and the apparatus is configured such that a portion of the agitation gas flow flows to the vacuum source as an agitation return flow through the common exit port.

7. The apparatus of claim 3 wherein:

the housing includes a dispensing portal; and the apparatus includes a gate system including a gate member positioned in the dispensing pathway, the gate member being selectively positionable between an open position and a closed position, wherein, when the gate member is in the open position, the gate member permits the articles to pass through the portal and, when the gate member is in the closed position, the gate member blocks the articles from passing through the portal.

8. The apparatus of claim 7 wherein the gate member includes perforations therein for the passage of the reverse drive gas flow.

9. The apparatus of claim 8 wherein:

the perforations are blocked when the gate member is in the open position; and the housing includes a return opening downstream along the dispensing flow path for the passage of the forward drive gas flow from the outlet to the vacuum source.

10. The apparatus of claim 1 wherein the at least one vacuum source is adapted to induce ambient air to flow into and through the housing as the forward drive gas flow.

11. The apparatus of claim 10 configured to generate the agitation gas flow and the forward drive gas flow simultaneously using vacuum pressure and induced gas flow from the same vacuum source via a common exit port of the housing.

12. An apparatus for dispensing solid articles, the apparatus comprising:

a housing defining a hopper chamber to hold the articles and a dispensing channel fluidly connected to the hopper chamber, the dispensing channel having an inlet and an outlet defining a dispensing flow path therebetween; and at least one vacuum source adapted to provide a vacuum pressure and induce a gas flow in the housing;

wherein the apparatus is configured to generate a forward drive gas flow from the vacuum pressure and induced gas flow, and the forward drive gas flow conveys articles through the dispensing channel along the dispensing flow path in a direction from the inlet to the outlet to dispense the articles;

wherein the apparatus is configured such that the forward drive gas flow flows along the dispensing flow path from the outlet to the vacuum source after passing through the dispensing channel;

wherein the apparatus is configured to generate a reverse drive gas flow from the vacuum pressure and induced gas flow, wherein the reverse drive gas flow conveys articles through the dispensing channel along the dispensing flow path in a direction from the outlet to the inlet to return the articles to the hopper chamber; and wherein the apparatus includes a control port in the housing and a closure mechanism operable to selectively open and close the control port, wherein:

when the control port is closed, the forward drive gas flow is generated from the vacuum pressure and induced gas flow; and when the control port is open, the reverse drive gas flow is generated from the vacuum pressure and induced gas flow.

13. The apparatus of claim 12 wherein, when the control port is open, the vacuum pressure draws ambient air into the housing to generate the reverse drive gas flow.

14. The apparatus of claim 12 wherein the closure mechanism includes an actuator operable to selectively open and close the control port.

15. An apparatus for dispensing solid articles, the apparatus comprising:

a housing defining a hopper chamber to hold the articles and a dispensing channel fluidly connected to the hopper chamber, the dispensing channel having an inlet and an outlet defining a dispensing flow path therebetween; and at least one vacuum source adapted to provide a vacuum pressure and induce a gas flow in the housing;

wherein the apparatus is configured to generate a forward drive gas flow from the vacuum pressure and induced gas flow, and the forward drive gas flow conveys articles through the dispensing channel along the dispensing flow path in a direction from the inlet to the outlet to dispense the articles;

wherein the apparatus is configured such that the forward drive gas flow flows along the dispensing flow path from the outlet to the vacuum source after passing through the dispensing channel;

wherein the apparatus is configured to generate a reverse drive gas flow from the vacuum pressure and induced gas flow, wherein the reverse drive gas flow conveys articles through the dispensing channel along the dispensing flow path in a direction from the outlet to the inlet to return the articles to the hopper chamber;

wherein:

the housing includes a dispensing portal; and the apparatus includes a gate system including a gate member positioned in the dispensing pathway, the gate member being selectively positionable between an open position and a closed position, wherein, when the gate member is in the open position, the gate member permits the articles to pass through the portal and, when the gate member is in the closed position, the gate member blocks the articles from passing through the portal; and wherein the apparatus includes a holding mechanism to hold the gate member in the closed position when the reverse drive gas flow is being generated.

16. A method for dispensing solid articles, the method comprising:

providing an apparatus including:

a housing defining a hopper chamber to hold the articles and a dispensing channel fluidly connected to the hopper chamber, the dispensing channel having an inlet and an outlet defining a dispensing flow path therebetween; and at least one vacuum source;

using the vacuum source, providing a vacuum pressure and inducing a gas flow in the housing;

generating a forward drive gas flow from the vacuum pressure and induced gas flow such that the forward drive gas flow conveys articles through the dispensing channel along the dispensing flow path in a direction from the inlet to the outlet to dispense the articles; and generating an agitation gas flow from the vacuum pressure and induced gas flow such that the agitation gas flow agitates articles in the hopper chamber;

wherein the apparatus is configured such that the forward drive gas flow flows along the dispensing flow path from the outlet to the vacuum source after passing through the dispensing channel.

17. The method of claim 16 wherein the apparatus includes an expansion region downstream of the outlet along the dispensing flow path, and including, using the forward drive gas flow, conveying the articles through the dispensing channel and into the expansion region where the velocity of the forward drive gas flow is reduced and the articles decouple from the forward drive gas flow to be dispensed.

18. The method of claim 17 further including generating a reverse drive gas flow from the vacuum pressure and induced gas flow such that the reverse drive gas flow conveys articles through the dispensing channel along the dispensing flow path in a direction from the outlet to the inlet to return the articles to the hopper chamber.

19. The method of claim 18 wherein:

the housing includes a dispensing portal;

the apparatus includes a gate system including a gate member positioned in the dispensing pathway; and the method further includes:

positioning the gate member in an open position wherein the gate member permits the articles to pass through the portal; and thereafter positioning the gate member in a closed position wherein the gate member blocks the articles from passing through the portal.

20. The method of claim 16 wherein the apparatus is configured such that a portion of the agitation gas flow flows to the vacuum source as an agitation return flow.

21. The method of claim 16 wherein the articles are pharmaceutical articles.

22. An apparatus for dispensing solid articles, the apparatus comprising:

a housing defining a hopper chamber to hold the articles and a dispensing channel fluidly connected to the hopper chamber, the dispensing channel having an inlet and an outlet defining a dispensing flow path therebetween, the housing including a dispensing portal;

at least one vacuum source adapted to provide a vacuum pressure and induce a gas flow in the housing;

a gate system including a gate member positioned in the dispensing pathway, the gate member being selectively positionable between an open position and a closed position, wherein, when the gate member is in the open position, the gate member permits the articles to pass through the portal and, when the gate member is in the closed position, the gate member blocks the articles from passing through the portal;

wherein the apparatus is configured to generate a forward drive gas flow from the vacuum pressure and induced gas flow, and the forward drive gas flow conveys articles through the dispensing channel along the dispensing flow path in a direction from the inlet to the outlet to dispense the articles;

wherein the apparatus is configured to generate a reverse drive gas flow from the vacuum pressure and induced gas flow, wherein the reverse drive gas flow conveys articles through the dispensing channel along the dispensing flow path in a direction from the outlet to the inlet to return the articles to the hopper chamber; and wherein the gate member includes perforations therein for the passage of the reverse drive gas flow.

23. The apparatus of claim 22 wherein:

the perforations are blocked when the gate member is in the open position; and the housing includes a return opening downstream along the dispensing flow path for the passage of the forward drive gas flow from the outlet to the vacuum source.

24. The apparatus of claim 22 configured such that the forward drive gas flow flows along the dispensing flow path from the outlet to the vacuum source after passing through the dispensing channel.

* * * * *